US005107391A

United States Patent [19]

Siepmann

[11] Patent Number: 5,107,391

[45] Date of Patent: Apr. 21, 1992

[54] CIRCUIT FOR DRIVING ONE OR MORE ELECTROMAGNETIC RELAYS WHICH USES MINIMUM POWER AND RESULTS IN MINIMUM TEMPERATURE IN THE RELAYS

[75] Inventor: Richard Siepmann, Munich, Fed. Rep. of Germany

[73] Assignee: Siemens Aktiengesellschaft, Munich, Fed. Rep. of Germany

[21] Appl. No.: 503,681

[22] Filed: Apr. 3, 1990

[30] Foreign Application Priority Data

Apr. 13, 1989 [EP] European Pat. Off. ..... 89106654

[51] Int. Cl.[5] ..... H01H 47/14

[52] U.S. Cl. ..... 361/168.1; 361/161; 361/166; 361/194; 323/265; 323/907

[58] Field of Search ..... 361/139, 140, 160, 161, 361/166, 168.1, 194; 323/265, 907

[56] References Cited

U.S. PATENT DOCUMENTS

| | | | |
|---|---|---|---|
| 3,748,537 | 7/1973 | Vigini | 361/139 |
| 3,884,318 | 5/1975 | Abel et al. | 361/160 |
| 4,410,808 | 10/1983 | Woodhouse | 361/190 |

FOREIGN PATENT DOCUMENTS

| | | |
|---|---|---|
| 3144000 | 5/1983 | Fed. Rep. of Germany . |
| 3504034 | 8/1986 | Fed. Rep. of Germany . |
| 3701985 | 8/1988 | Fed. Rep. of Germany . |
| 2568715 | 3/1984 | France . |

OTHER PUBLICATIONS

Article entitled "Schaltungspraxis 2087 Elektronic 33" (1984) Okt., No. 20, pp. 117-118.

*Primary Examiner*—A. D. Pellinen
*Assistant Examiner*—Jeffrey A. Gaffin
*Attorney, Agent, or Firm*—Hill, Van Santen, Steadman & Simpson, A Professional Corporation

[57] ABSTRACT

A circuit arrangement for driving at least one electromagnetic relay provides that all of the excitation circuits can be connected to a constant voltage source in parallel relative to each other and jointly in series with the switching path of an electronic switch (FET). The electronic switch (FET) is switched through and blocked in impulsive manner whereby the pulse-duty factor is adjusted in a control unit depending on the operating voltage ($U_B$) and the ambient temperature of the relay so that it does not fall below the minimum holding current required for the connected relays.

9 Claims, 2 Drawing Sheets

CIRCUIT FOR DRIVING ONE OR MORE ELECTROMAGNETIC RELAYS WHICH USES MINIMUM POWER AND RESULTS IN MINIMUM TEMPERATURE IN THE RELAYS

BACKGROUND OF THE INVENTION

1. Field of the Invention

This invention relates in general to a circuit arrangement for driving at least one electromagnetic relay by way of an electronic switch which is controlled and made conductive in an impulse fashion.

2. Description of Related Art

The impulse driving of relays is known, for example, in DE-A-31 44 000. Due to impulse driving, it is possible to adjust the resulting current through the coil to a minimum value which corresponds to the required holding excitation so as to keep the power used in the coil and, thus, the heating of the relay as low as possible. A positively adjusted pulse duty factor for such impulse driving can, however, only be used if the voltage does not change and if the ambient temperature remains approximately the same. See also, DE 37 01 985, French 2,568,715, German DE 35 04 034 and the article in 2087 Elektronik, 33 (1984) October No. 20, Muenchen, Deutschland, Pages 117 and 118.

SUMMARY OF THE INVENTION

One application for the present invention is for relays used in motor vehicles where they are mounted in densely packed relay boxes where they are exposed to wide temperature fluctuations not only from the outside, but also where the risk of mutual heating occurs within the relay boxes. As a further problem is added, the fact that the battery voltage in a motor vehicle fluctuates very broadly. So as to provide that the individual relays will safely respond even under low battery voltage conditions and high ambient temperatures the trip coils are adjusted toward the safe side, in other words, for the most unfavorable case which during continuous operation results in a correspondingly high development of heat in respective relays and for the adjacent relays.

Since in the case of such applications each relay is switched on different times and for different lengths of times, the impulse driving previously known in the art had to be performed in a manner such that in each individual relay coil the current or voltage in the coil would be individually measured and evaluated for the corresponding control of an associated electronic switch. The increase in the number of relays employed in a motor vehicle and in comparable applications, causes such individual drive circuits to be very costly, and also require large space.

It is an object of the present invention to provide a drive circuit for relays which makes it possible to drive an arbitrary number of jointly mounted relays which are individually switched such that it is possible to respectively assure that safe holding excitation currents exists and also to prevent high power consumption and undesired development of heat.

In the invention, the circuit arrangement has the following characteristics: all exciting circuits of the individually switchable relay windings can be connected in a parallel manner relative to each other with the first terminal to one pole of a DC voltage source and with the second terminal through a switching path of an electronic switch to a second pole of the DC voltage source. A control unit is provided which impulsively switches through and blocks the electronic switch and the pulse duty factor of the switch-through pulses is adjusted in the control unit depending on the operating DC voltage of the voltage source and on the ambient temperature of the relays so that minimum holding current required for the connected relays always exist.

The drive circuit of the invention thus provides that a minimum holding current is selected in the control unit such that it just assures that all connected relays will be maintained in the closed condition and whereby fluctuations of the operating voltage and the ambient temperature are taken into account.

Although the circuit basically functions with one relay, special advantages result when a group of relays are being driven since the control unit can control a number of relays.

Expediently, the pulse duty factor of the switch-through pulses is adjusted in the control unit such that for each of the connected relays the holding excitation is barely generated. If, for example, the DC voltage drops to the holding voltage, the clocking changes the continuous current. Since the holding voltage is about 50% of the nominal voltage, it is possible to save 75% of the power. If, however, the operating voltage increases above the nominal voltage, in other words, in a motor vehicle to 15 volts instead of 12 volts nominal voltage only one-sixth of the heat is generated in this critical case making it possible to considerably lower the temperature of the relay box of a motor vehicle.

However, so as to assure the safe holding of a respective relay when it is connected when generally adjusting the pulse duty factor to holding excitation, every excitation circuit of a relay is scanned and sampled by a monitoring circuit and if an additional relay is added, a continuous impulse is fed to the electronic switch respectively for the turn-on time. Such initial step for the recognition of the drive condition is necessary for every relay, however, the costs for the entire arrangement are not increased very much since the main part of the control unit with power, in other words, the electronic switch must only be provided one time for the entire arrangement.

The control unit can contain a digital control device, in other words, a micro-controller whereby the drive conditions of the individual relays are supplied as digital input parameters and the values for the ambient temperatures measured by sensors and the operating voltage are supplied as analog input parameters. The parameters of the relays to be connected are stored in this case in the form of tables or characteristic fields so that according to a computing rule for the respective input values the corresponding pulse duty factor for the electronic switch can be calculated. Instead of digital control analog control can be utilized also. In this case, an expedient embodiment provides that the control unit has a reference coil arranged in thermal contact to the relays and whose time constant is less than or equal to that of the fastest responding relay whereby the current flowing in the reference coil is monitored by current monitoring and evaluated for the determination of the pulse duty factor. This evaluation can occur in that the electronic switch is switched off when the current in the reference coil surpasses a prescribed threshold value above the holding current of the relays and the electronic switch is switched on when the current and the reference coil falls below a prescribed threshold value for the holding current. This current monitoring can result with standard sensors like a precision resistor. It is also useful to have current monitoring by measuring the magnetic flow in the reference coil by way of a field plate.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

DESCRIPTION OF THE PREFERRED EMBODIMENTS

Figure 1:
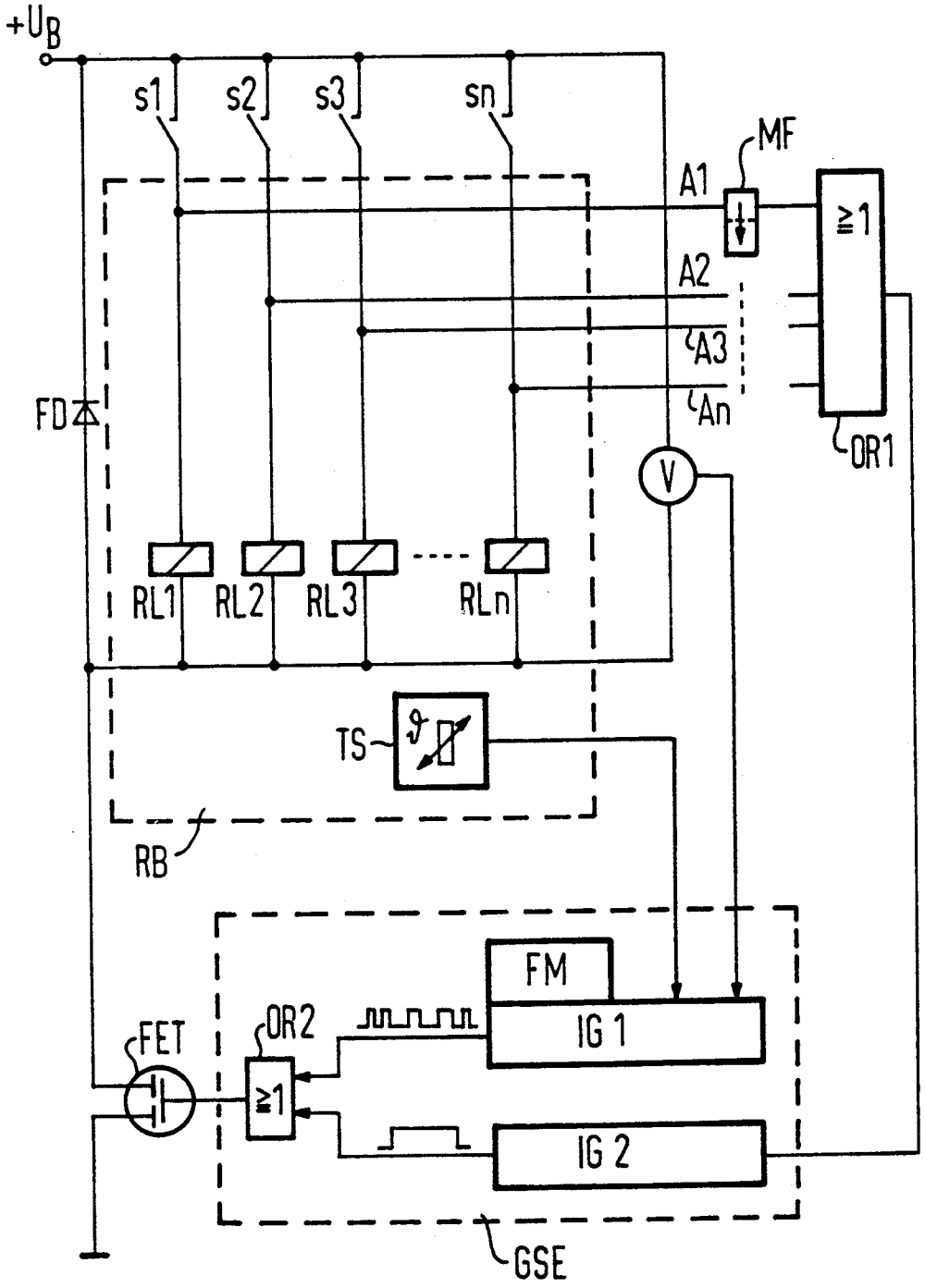
FIG. 1 is a partially schematic circuit arrangement of a drive circuit with a digital control unit.

FIG. 1 illustrates a drive circuit for a series of relays which have exciting coils RL1, RL2, RL3 . . . RLn which are connected in a parallel manner by associated switches s1, s2, s3 . . . sn which allows them to be connected to the operating voltage $U_B$ in a selectively individual manner. The other sides of the exciting coils RL1 through RLn which are opposite to the switches s1 through sn are connected in series with the electronics switch which, by example, may be a field effect transistor FET and which has its other side connected to ground. All of the relays RL1 through RLn are mounted in a relay box RB which is indicated by dashed line in FIG. 1.

The electronic switch FET is made conductive in an impulsive fashion by a group control unit GCU which includes an impulse generator IG1 which generates a pulse duty factor at least corresponding to the holding excitation for the connected relays which are switched on. This pulse duty factor is determined depending on the DC voltage $U_B$ and the temperature existing in the relay boxes RB. A volt mete V is connected in parallel to the excitation circuits as illustrated and a temperature sensor TS which is mounted in the relay box RB indicates the temperature value within the relay box. From the operating voltage and the temperature, the pulse duty factor is determined respectively according to a function depending on the relay parameters. This function of the parameters are stored in a function memory FM which is connected to the impulse generator IG1. So as to allow current flow through the trip coil during the turn-off time of the electronic switch FET, a recovery diode FD is connected in a known manner in a parallel fashion to the windings.

When one of the relays RL1 through RLn is switched on, the voltage change is detected at a connected sampling scanning line A1 through An and evaluated so as to switch through a monostable circuit MF. This scanning is schematically illustrated in FIG. and as far as level adjustment, a person skilled in the art can do this in a conventional manner. The response of a monostable circuit MF of one of the sampling lines Al through An is recognized in the OR-element OR1 and evaluated by the impulse generator IG2 in the group control GSE so as to generate a continuous impulse. The continuous impulse lasts at least as long for the safe response of each of the connectible relays. By way of the OR-element OR2 the continuous impulse is supplied to the holding current impulses of the impulse generator IG1 so that the electronic switch FET remains conductive for the duration of the response of the newly connected relay.

Figure 2:
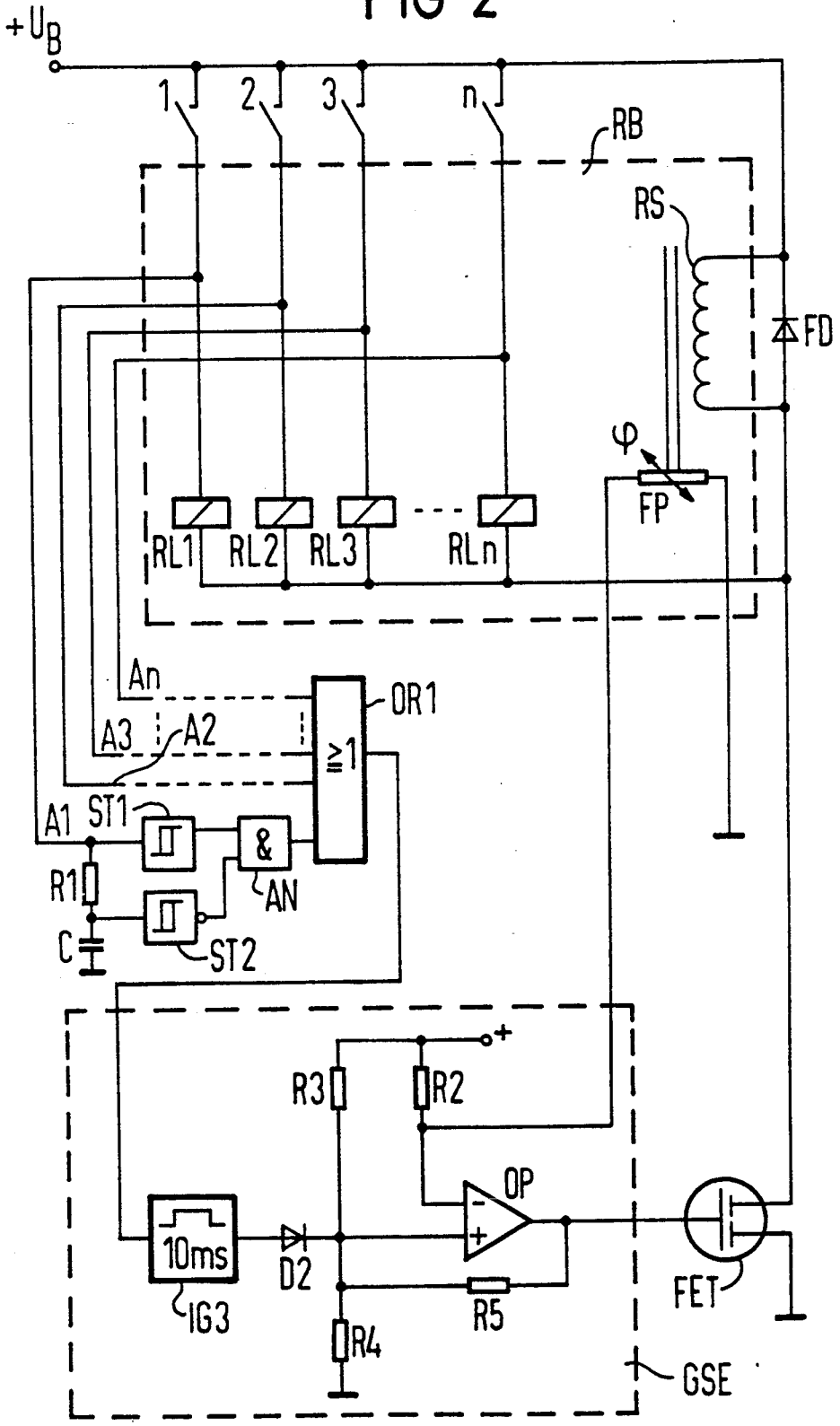
FIG. 2 is a partially schematic view of a similar drive circuit using an analog operating control unit.

FIG. 2 illustrates a somewhat modified embodiment for an analog functioning group control unit GCU. The components or logic switching elements of FIG. 2 correspond to those of FIG. 1 in their function and where this occurs the same reference symbols are used. In FIG. 2, the exciting coils RL1 through RLn can be connected to the DC voltage $U_B$ by way of the switches s1 through sn in a selectively parallel manner. The connection is scanned by the sampling lines A1 through An as in the FIG. 1 example by way of two Schmitt-Trigger circuits ST1 and ST2 which provide a sampling of the voltage jump which occurs between the resistor R1 and the capacitor C connected as shown between the Schmitt-Triggers. The output of the Schmitt-Triggers are evaluated by the AND gate AN to generate a signal to supply to the OR-element OR1. A continuous impulse, for example, of 10 ms is generated in a corresponding impulse generator IG3 shown in FIG. 2, each time an additional relay is connected. This continuous impulse is directly fed to the electronic switch FET by way of the diode D2 and the operation amplifier OP connected as shown.

In the embodiment of FIG. 2, the actual duty cycle factor for normal operation is determined by a reference coil RS which is mounted in the relay box RB and has a time constant of F/R which is less than or equal to the time constant of the fastest switching relay. This reference coil is connected to the operating voltage in parallel to the exciting coils of the relay and to obtain the pulse duty factor its current is monitored. Since the reference coil is in thermal contact with the relays, its resistance changes like that of the exciting coils. Also, the current increase is accelerated with a higher operating voltage which results in a reduction of the on switching time.

The current monitoring can occur in a known manner at a precision resistor and in the shown embodiment it occurs by way of a magnetic flow measurement with a field plate FP at the reference coil RS. The field plate FP changes its resistance with the magnetic flow in the reference coil. As a controllable resistance, it is integrated in the voltage divider circuit at the two inputs of the operational amplifier OP through the resistors R2, R3 and R4.

If the current in the reference coil RS falls below a value corresponding to the holding current for the connected relays, the electronic switch is switched on by way of the operational amplifier OP and switched off again when a prescribed current exists which is 10% higher. With a switched off electronic switch FET, the current continues to flow in a known manner in parallel fashion relative to the coils by way of the common recovery diode FD.

Although the invention has been described with respect to preferred embodiments, it is not to be so limited as changes and modifications can be made which are within the full intended scope of the invention as defined by the appended claims.

I claim as my invention:

1. A circuit arrangement including a plurality of relays each of which have individually switchable windings, said circuit arrangement adapted to drive at least one of said relays at a time, comprising a plurality of exciting circuits with one for each of said individually switchable relay windings (RL1 to RLn) and said plurality of exciting circuits connected in parallel with each other and with a first terminal connected to one pole of a DC voltage source ($U_B$), and a second terminal connected through the switching path of an electronic switch (FET) to a second pole of said DC voltage source, a control unit GCU connected so as to impulsively switch through and block the electronic switch (FET), and the pulse-duty-factor of the switch-through pulses is adjusted in said control unit GCU as functions of the voltage ($U_B$) of the DC voltage source and the ambient temperature of the relays such that the minimum holding current required for the ones of said plurality of relays which are connected to said voltage source and an a particular time is maintained.

2. A circuit arrangement according to claim 1 wherein all of said excitation circuits of said plurality of relays are scanned and sampled by a monitoring circuit (A1 to An), and when an excitation circuit of a relay is switched on a continuous impulse is fed to the electronic switch (FET) for the turn-on time of said relay.

3. A circuit arrangement according to claim 2, the turning-on of a relay is evaluated by monitoring the voltage for the generation of a digital signal, which triggers a continuous impulse of a prescribed length in the control unit.

4. A circuit arrangement according to claim 1 including, a temperature sensor (TS) mounted in contact with at least one of said plurality of relays and a voltage meter (V) connected to sense the voltage of the DC voltage source, outputs of said temperature sensor and said voltmeter supplied to a digital control unit (IG1) which generates a pulse-duty factor for the through-switching pulses and uses a stored function which depends on the parameters of said relays.

5. A circuit arrangement according to claim 1 comprising a reference coil (RS) for sensing temperature and operating voltage and which has a time constant which is less than or equal to that of the fastest switching one of said plurality of relays, a reference coil (RS) mounted in thermal contact with at least one portion of the relays and connected to the DC voltage source in parallel to the exciting coils (RL1 to RLn), and the current flowing through the reference coil is monitored and evaluated for the determination of the pulse-duty factor.

6. A circuit arrangement according to claim 5, wherein said electronic switch (FET) is switched off when the current in the reference coil (RS) is greater than a prescribed threshold value for the holding current of the relays, and is switched on when the current in the reference coil (RS) is less than a prescribed threshold value for the holding current.

7. A circuit arrangement according to claim 5 wherein the current monitoring is done with a precision resistor which is integrated in the circuit of the reference coil.

8. A circuit arrangement according to claim 5 wherein the current monitoring is done by measuring the magnetic flow in the reference coil.

9. A circuit arrangement according to claim 8, wherein the magnetic flow of the reference coil is scanned with a field plate (FP) which is integrated in a voltage divider circuit of a reference generator (R2, R3, R3, OP).

* * * * *